US012195923B2

(12) United States Patent
Pierce

(10) Patent No.: US 12,195,923 B2
(45) Date of Patent: Jan. 14, 2025

(54) METHOD OF PRODUCING A PULP PRODUCT

(71) Applicant: Celwise AB, Norrköping (SE)

(72) Inventor: David Pierce, Norrköping (SE)

(73) Assignee: Celwise AB, Norrköping (SE)

( * ) Notice: Subject to any disclaimer, the term of this patent is extended or adjusted under 35 U.S.C. 154(b) by 0 days.

(21) Appl. No.: 18/235,121

(22) Filed: Aug. 17, 2023

(65) Prior Publication Data

US 2023/0392322 A1 Dec. 7, 2023

Related U.S. Application Data

(63) Continuation of application No. 17/261,155, filed as application No. PCT/EP2019/069513 on Jul. 19, 2019, now abandoned.

(30) Foreign Application Priority Data

Jul. 19, 2018 (SE) ..... 1850918-2

(51) Int. Cl.
*D21J 3/10* (2006.01)
*D21J 7/00* (2006.01)

(52) U.S. Cl.
CPC .. *D21J 3/10* (2013.01); *D21J 7/00* (2013.01)

(58) Field of Classification Search
CPC ..... D21J 3/10; D21J 7/00; D21J 3/00; B29C 51/10; B29C 51/36
See application file for complete search history.

(56) References Cited

U.S. PATENT DOCUMENTS 3,788,032 A 1/1974 Heffernan et al.
6,605,187 B1 8/2003 Nonomura et al.
9,149,948 B2 10/2015 Kuo et al.
(Continued)

FOREIGN PATENT DOCUMENTS

CA 2971516 C 10/2020
CN 1307154 A 8/2001
(Continued)

OTHER PUBLICATIONS

International Search Report and Written Opinion for International Application No. PCT/EP2019/069513, mailed Mar. 10, 2020, (12 pages).
(Continued)

*Primary Examiner* — Jose A Fortuna
(74) *Attorney, Agent, or Firm* — Kagan Binder, PLLC

(57) ABSTRACT

A method of producing a 3D molded product comprises applying a pulp slurry layer to a porous forming face of a first mold, pressing the pulp slurry layer against the porous forming face of the first mold, while heating the pulp slurry layer and drawing a vacuum through the porous forming face of the first mold, transferring the pulp slurry layer to a porous forming face of a second mold, in a subsequent forming step, pressing the pulp slurry layer against the porous forming face of the second mold, while heating the pulp slurry layer and drawing a vacuum through the porous forming face of the second mold. In the method, a first pressure at the rear side of the forming face of the porous forming face of the first mold is lower than a second pressure at the rear side of the porous forming face of the second mold.

20 Claims, 2 Drawing Sheets

(56) References Cited

U.S. PATENT DOCUMENTS

| | | | | |
|---|---|---|---|---|
| 9,650,746 | B2 | 5/2017 | Kuo et al. | |
| 9,739,016 | B2 | 8/2017 | Kuo et al. | |
| 9,803,322 | B2 | 10/2017 | Kuo et al. | |
| 10,435,848 | B2 | 10/2019 | Andersson et al. | |
| 10,801,164 | B2 | 10/2020 | Andersson et al. | |
| 11,365,518 | B2 | 6/2022 | Hardacre et al. | |
| 11,391,001 | B2 * | 7/2022 | Andersson | B22F 3/1109 |
| 12,060,682 | B2 * | 8/2024 | Pierce | D21J 3/00 |
| 2016/0168793 | A1 | 6/2016 | Kuo et al. | |
| 2016/0168800 | A1 | 6/2016 | Kuo et al. | |
| 2016/0168801 | A1 | 6/2016 | Kuo et al. | |
| 2016/0244917 | A1 | 8/2016 | Kuo et al. | |
| 2016/0368235 | A1 | 12/2016 | Kuo et al. | |
| 2017/0370049 | A1 | 12/2017 | Andersson et al. | |
| 2019/0194870 | A1 | 6/2019 | Kuo et al. | |
| 2019/0284764 | A1 | 9/2019 | Kuo et al. | |
| 2019/0301102 | A1 | 10/2019 | Kuo et al. | |
| 2021/0269983 | A1 * | 9/2021 | Pierce | D21J 7/00 |
| 2021/0292974 | A1 * | 9/2021 | Pierce | B32B 23/10 |
| 2022/0049432 | A1 * | 2/2022 | Pierce | D21J 3/10 |
| 2022/0081846 | A1 | 3/2022 | Pierce | |
| 2022/0081847 | A1 | 3/2022 | Pierce | |
| 2022/0162805 | A1 * | 5/2022 | Appleford | B65B 47/10 |
| 2022/0403604 | A1 * | 12/2022 | Andersson | D21J 5/00 |
| 2023/0392322 | A1 * | 12/2023 | Pierce | D21J 7/00 |

FOREIGN PATENT DOCUMENTS

| | | | | |
|---|---|---|---|---|
| CN | 101967767 | A | 2/2011 | |
| CN | 102409578 | A | 4/2012 | |
| CN | 103388290 | A | 11/2013 | |
| CN | 204849488 | U | 12/2015 | |
| CN | 205295813 | U | 6/2016 | |
| CN | 205443807 | U | 8/2016 | |
| CN | 205688279 | U | 11/2016 | |
| CN | 107109803 | A | 8/2017 | |
| CN | 107559251 | A | 1/2018 | |
| CN | 207277101 | U | 4/2018 | |
| CN | 108708226 | A | 10/2018 | |
| CN | 112513372 | A | 3/2021 | |
| CN | 113272495 | A | 8/2021 | |
| DE | 102016113201 | A1 | 1/2018 | |
| EP | 0013011 | A1 | 7/1980 | |
| EP | 1104822 | A2 | 6/2001 | |
| EP | 1815066 | B1 * | 9/2011 | D21J 1/06 |
| GB | 260362 | A | 11/1926 | |
| GB | 931246 | A | 7/1963 | |
| GB | 2416143 | A | 1/2006 | |
| JP | H10227000 | A | 8/1998 | |
| JP | 2000034700 | A | 2/2000 | |
| KR | 20010091687 | A | 10/2001 | |
| KR | 20080051670 | A | 6/2008 | |
| KR | 20190000074 | U | 1/2019 | |
| TW | M511949 | U | 11/2015 | |
| TW | M515462 | U | 1/2016 | |
| TW | M515566 | U | 1/2016 | |
| TW | M519157 | U | 3/2016 | |
| TW | 201711926 | A | 4/2017 | |
| TW | 621751 | B | 4/2018 | |
| WO | 9722755 | A1 | 6/1997 | |
| WO | 9922069 | A1 | 5/1999 | |
| WO | 2006057609 | A1 | 6/2006 | |
| WO | 2006057610 | A2 | 6/2006 | |
| WO | 2006057611 | A1 | 6/2006 | |
| WO | 2007084067 | A1 | 7/2007 | |
| WO | 2007106026 | A1 | 9/2007 | |
| WO | 2007129972 | A1 | 11/2007 | |
| WO | 2011059391 | A1 | 5/2011 | |
| WO | 2011059392 | A1 | 5/2011 | |
| WO | 2011059393 | A1 | 5/2011 | |
| WO | 2011059394 | A1 | 5/2011 | |
| WO | 2011065911 | A1 | 6/2011 | |
| WO | 2011159240 | A1 | 12/2011 | |
| WO | 2012005683 | A1 | 1/2012 | |
| WO | 2012033449 | A1 | 3/2012 | |
| WO | WO-2016101976 | A1 * | 6/2016 | B22F 3/1109 |
| WO | 2020016416 | A2 | 1/2020 | |
| WO | WO-2020016407 | A1 * | 1/2020 | B31B 50/72 |
| WO | 2020016416 | A3 | 4/2020 | |
| WO | 2020141205 | A1 | 7/2020 | |
| WO | 2020141209 | A1 | 7/2020 | |
| WO | WO-2020141208 | A1 * | 7/2020 | B29C 33/02 |

OTHER PUBLICATIONS

Swedish Search Report for Swedish Application No. 1850918-2, mailed Jan. 29, 2019, (5 pages).

First Chinese Office Action, and English Translation therefore, for Chinese Counterpart Application No. 201980050393.8, mailed May 15, 2024, (22 pages).

* cited by examiner

METHOD OF PRODUCING A PULP PRODUCT

CROSS-REFERENCE TO RELATED APPLICATIONS

This application is a Continuation U.S. patent application Ser. No. 17/261,155, filed Jan. 18, 2021, and titled "METHOD OF PRODUCING A PULP PRODUCT," which in turn claims priority to International Application No. PCT/EP2019/06913, filed Jul. 19, 2019 and titled "METHOD OF PRODUCING A PULP PRODUCT," which in turn claims priority from a Swedish Patent Application having serial number 1850918-2, filed Jul. 19, 2018, titled "METHOD OF PRODUCING A PULP PRODUCT," all of which are incorporated herein by reference in their entireties.

TECHNICAL FIELD

The present disclosure relates to a method of producing a molded pulp product. The method is particularly suitable for 3D molding of products from a pulp slurry. Such products may include trays, cups, plates and various containers for packaging.

BACKGROUND

From WO2016101976A1 there is known a method of producing products from a pulp slurry by applying the slurry layer to a porous mold and removing water from the slurry by simultaneously heating and pressing the slurry layer while drawing a vacuum through a mold wall, the other side of which being in contact with the slurry layer. As is disclosed in WO2016101976A1, the molding process may be performed in two or more successive pressing steps, which is advantageous as it shortens cycle time and thus increases the throughput of the production process, as compared to a process with a single pressing step. In addition to increasing throughput, it is desirable to provide a process which is energy efficient as well.

SUMMARY

An object of the present disclosure is to provide a more energy efficient method of producing products from pulp slurry.

The invention is defined by the appended independent claims, with embodiments being set forth in the appended dependent claims, in the following description and in the attached drawings.

According to a first aspect, there is provided a method of producing a 3D molded product from a pulp slurry, comprising applying a pulp slurry layer to a porous forming face of a first mold, in a first forming step, pressing the pulp slurry layer against the porous forming face of the first mold, while heating the pulp slurry layer and drawing a vacuum through the porous forming face of the first mold, transferring the pulp slurry layer to a porous forming face of a second mold, in a second, subsequent, forming step, pressing the pulp slurry layer against the porous forming face of the second mold, while heating the pulp slurry layer and drawing a vacuum through the porous forming face of the second mold. In the method, a first pressure at the rear side of the forming face of the first mold is lower than a second pressure at the rear side of the forming face of the second mold.

That is, the pressure provided at the rear sides of the forming faces during the pickup and pressing steps is lower than ambient pressure. Hence, the pressure can be seen as a vacuum.

Each mold may comprise at least two interacting mold parts, which are pressed towards each other and at least one of which presents the porous forming face. Some mold parts, or portions of a mold part, may have a nonporous surface, e.g. such portions where a specific surface structure is desired.

The invention is based on the understanding that a lower vacuum level is required in the second forming step than in the first forming step, which allows a saving of energy. This saving may be significant, as a substantial amount of energy is consumed by the vacuum equipment.

The first pressure may be 1-99% of the second pressure, preferably 50-99% or 90-99%. Optionally, the first pressure may be 95-99% of the second pressure, or even 99-99.9% of the second pressure.

The first pressure may be 200-900 mbarA (millibar absolute), preferably 300-800 mbarA.

The first pressure may be 200-300 mbarA, 300-400 mbarA, 400-500 mbarA, 500-600 mbarA, 600-700 mbarA, 700-800 mbarA, or 800-900 mbarA.

The drawing of vacuum through the porous forming face of the first mold may be initiated before the pressing of the pulp slurry layer against the porous forming face of the first mold is initiated.

Initiation of vacuum through the porous forming face of the mold is deemed to be initiated at the time when an underpressure, i.e., an air pressure lower than that present at the forming face is formed at the rear face of the porous forming face.

Initiation of the pressing of the pulp slurry layer against the porous forming face of the first mold part of the first mold is deemed to be initiated at first contact of the other mold part of the first mold with the pulp slurry layer.

The drawing of vacuum through the porous forming face may be initiated 0.01-1 second before the pressing of the pulp layer against the porous forming face of the first mold is initiated.

The vacuum may be drawn through the porous forming face of the first mold during a first vacuum suction time of 0.1-5.0 second, preferably 0.1-3.0 second, more preferably 0.5-2.0 second.

In the first forming step, the forming face of the first mold may be heated to about 150-500° C., preferably 150-400° C., 200-500° C., 200-400° C. or 200-300° C.

In the first forming step, the pulp slurry layer may be pressed against the forming face of the first mold with a pressure of about 390-1570 kPa, preferably 580-1170 kPa.

In the first forming step, the pulp slurry layer may be pressed against the forming face of the first mold during a first pressing time of 0.1-4.0 second, preferably 0.5-2.0 second.

In the first forming step, an initial water content of the pulp slurry layer may be 70-90% by weight and a final water content may be 45-65% by weight, preferably about 50-60% by weight.

The initial water content is taken when the pulp slurry layer is introduced into the first mold. The final water content is taken when the pulp slurry layer is removed from the first mold.

A second pressure may be 200-900 mbarA, preferably 300-800 mbarA.

The second pressure may be 200-300 mbarA, 300-400 mbarA, 400-500 mbarA, 500-600 mbarA, 600-700 mbarA, 700-800 mbarA or 800-900 mbarA. The drawing of vacuum through the porous forming face of the second mold may be initiated before the pressing of the pulp slurry layer against the porous forming face of the second mold is initiated.

Initiation of vacuum through the porous forming face of the mold is deemed to be initiated at the time when an underpressure, i.e., an air pressure lower than that present at the forming face is formed at the rear face of the porous forming face.

Initiation of the pressing of the pulp slurry layer against the porous forming face of the first mold part of the second mold is deemed to be initiated at first contact of the other mold part of the second mold with the pulp slurry layer.

The drawing of vacuum through the porous forming face may be initiated 0.01-1 second before the pressing of the pulp layer against the porous forming face of the second mold is initiated.

The vacuum may be drawn through the porous forming face of the second mold during a second vacuum suction time of 0.1-5.0 second, preferably 0.1-3.0 second, more preferably 0.5-2.0 second.

In the second forming step, the forming face of the second mold may be heated to about 110-500° C., preferably 110-400° C., 200-500° C., 200-400° C. or 200-300° C.

In the second forming step, the pulp slurry layer may be pressed against the forming face of the second mold with a pressure of about 3901570 kPa, preferably 580-1170 kPa.

In the second forming step, the pulp slurry layer may be pressed against the forming face of the second mold during a second pressing time of 0.1-4.0 second, preferably 0.5-2.0 second.

In the second forming step, an initial water content of the pulp slurry layer may be about 45-65%, preferably about 50-60% by weight, by weight and a final water content may be about 25-40% by weight, preferably about 30-35% by weight.

The method may further comprise transferring the pulp slurry layer to a porous forming face of a third mold, and in a third, subsequent, forming step, pressing the pulp slurry layer against the porous forming face of the third mold, while heating the pulp slurry layer and drawing a vacuum through the porous forming face of the third mold thereby providing a third pressure at the rear side of the porous forming face of the third mold, wherein the second pressure is greater than the third pressure.

The third pressure may be 200-900 mbarA, preferably 300-800 mbarA.

The third pressure may be 200-300 mbarA, 300-400 mbarA, 400-500 mbarA, 500-600 mbarA, 600-700 mbarA, 700-800 mbarA or 800-900 mbarA.

The drawing of vacuum through the porous forming face of the third mold may be initiated before the pressing of the pulp slurry layer against the porous forming face of the third mold is initiated.

Initiation of vacuum through the porous forming face of the mold is deemed to be initiated at the time when an underpressure, i.e., an air pressure lower than that present at the forming face is formed at the rear face of the porous forming face.

Initiation of the pressing of the pulp slurry layer against the porous forming face of the first mold part of the third mold is deemed to be initiated at first contact of the other mold part of the third mold with the pulp slurry layer.

The drawing of vacuum through the porous forming face may be initiated 0.01-1 second before the pressing of the pulp layer against the porous forming face of the third mold is initiated.

The vacuum may be drawn through the porous forming face of the third mold during a third vacuum suction time of 0.1-5.0 second, preferably 0.1-3.0 second, more preferably 0.5-2.0 second.

The second pressure may be 1-99% of the third pressure, preferably 50-99% or 90-99%. Optionally, the second pressure may be 95-99% of the third pressure, or even 99-99.9% of the third pressure.

The forming face of the third mold may be heated to about 100-300° C., preferably 200-280° C.

In the third forming step, the pulp slurry layer may be pressed against the forming face of the third mold with a pressure of about 390-1570 kPa, preferably 580-1170 kPa.

In the third forming step, the pulp slurry layer may be pressed against the forming face of the third mold during a third pressing time of 0.1-4.0 second, preferably 0.5-2.0 second.

In the third forming step, an initial water content of the pulp slurry layer may be about 25-45% or 25-40% by weight, preferably about 30-40% or 3035% by weight, and a final water content may be less than about 5% by weight, preferably less than about 1% by weight.

In one embodiment, in the first forming step, an initial water content of the pulp slurry layer may be 70-90% by weight and a final water content may be 25-50% by weight, preferably about 30-35% by weight.

In the second forming step, an initial water content of the pulp slurry layer may be about 25-50%, preferably about 30-35% by weight, and a final water content may be less than about 5% by weight, preferably less than about 1% by weight.

In one embodiment, said applying a pulp slurry layer to a porous forming face of a first mold may be preceded by a step of applying a pulp slurry comprising 99-99.9% water to a porous forming face of a pickup mold, and drawing a vacuum through the porous forming face of the pickup mold to form the pulp slurry layer.

After drawing a vacuum through the porous forming face of the pickup mold, a final water content of the pulp slurry layer may be about 70-90%, preferably about 70-80% by weight.

A suction flow rate through the porous forming face of the pickup mold, during the drawing of a vacuum through the porous forming face of the pickup mold to form the pulp slurry layer from the pulp slurry, may be 10-2500 l/sec per square meter of the porous forming face, preferably 10-2000 l/sec per square meter of the porous forming face.

Consequently, the total amount of water drawn through the porous forming face of the pickup mold may be 10-2500 liters/second per square meter of the porous forming face.

It is understood that the suction flow rate may vary depending on type of product molded.

It is further understood that the suction flow rate may vary between different portions of the porous forming face presenting varying porosity.

A suction flow rate through the porous forming face of the pickup mold, during the drawing of a vacuum through the porous forming face of the pickup mold to form the pulp slurry layer from the pulp slurry, may be 10-50 l/sec, 50100 l/sec, 100-250 l/sec, 250-500 l/sec, 500-750 l/sec, 750-1000 l/sec, 1000-1250 l/sec, 1250-1500 l/sec, 1500-1750 l/sec, 1750-2000 l/sec, or 2000-2500 l/sec per square meter of the porous forming face.

In the first forming step, a suction flow rate through the porous forming face of the first mold may be 1-50% of a suction flow rate through the porous forming face of the pickup mold during the drawing of a vacuum through the porous forming face of the pickup mold to form the pulp slurry layer from the pulp slurry, preferably 1-30% or 1-15% of a suction flow rate through the porous forming face of the pickup mold during the drawing of a vacuum through the porous forming face of the pickup mold to form the pulp slurry layer from the pulp slurry.

In another embodiment, said applying a pulp slurry layer to a porous forming face of a first mold comprises applying a pulp slurry comprising 9999.9% water to the porous forming face of the first mold, and drawing a vacuum through the porous forming face of the first mold to form the pulp slurry layer.

A final water content of the pulp slurry layer may be about 70-90%, preferably about 70-80% by weight.

A suction flow rate through the porous forming face of the first mold, during the drawing of a vacuum through the porous forming face of the first mold to form the pulp slurry layer from the pulp slurry, may be 10-25001/sec per square meter of the porous forming face, preferably 10-20001/sec per square meter of the porous forming face.

Consequently, the total amount of water drawn through the porous forming face of the first mold may be 10-2500 liters/second per square meter of the porous forming face.

It is understood that the suction flow rate may vary depending on type of product molded.

It is further understood that the suction flow rate may vary between different portions of the porous forming face presenting varying porosity.

A suction flow rate through the porous forming face of the first mold, during the drawing of a vacuum through the porous forming face of the first mold to form the pulp slurry layer from the pulp slurry, may be 10-50 l/sec, 50100 l/sec, 100-250 l/sec, 250-500 l/sec, 500-750 l/sec, 750-1000 l/sec, 10001250 l/sec, 1250-1500 l/sec, 1500-1750 l/sec, 1750-2000 l/sec, or 2000-2500 l/sec per square meter of the porous forming face.

In the first forming step, a suction flow rate through the porous forming face of the first mold may be 1-50% of a suction flow rate through the porous forming face of the first mold during the drawing of a vacuum through the porous forming face of the first mold to form the pulp slurry layer from the pulp slurry, preferably 1-30% or 1-15% of a suction flow rate through the porous forming face of the first mold during the drawing of a vacuum through the porous forming face of the first mold to form the pulp slurry layer from the pulp slurry.

According to any one of the embodiments, in the first forming step, a suction flow rate through the porous forming face of the first mold may be 10-2500 l/sec per square meter of the porous forming face, preferably 10-2000 l/sec per square meter of the porous forming face.

Consequently, in the first forming step, the total amount of water drawn through the porous forming face of the first mold may be 10-2500 liters/second per square meter of the porous forming face.

It is understood that the suction flow rate may vary depending on type of product molded.

It is further understood that the suction flow rate may vary between different portions of the porous forming face presenting varying porosity.

In the first forming step, a suction flow rate through the porous forming face of the first mold may be 10-50 l/sec, 50-100 l/sec, 100-250 l/sec, 250500 l/sec, 500-750 l/sec, 750-1000 l/sec, 1000-1250 l/sec, 1250-1500 l/sec, 1500-1750 l/sec, 1750-2000 l/sec, or 2000-2500 l/sec per square meter of the porous forming face.

In the second forming step, a suction flow rate through the porous forming face of the second mold may be 10-2500 l/sec per square meter of the porous forming face, preferably 10-2000 l/sec per square meter of the porous forming face.

Consequently, in the second forming step, the total amount of water drawn through the porous forming face of the second mold may be 10-2500 liters/second per square meter of the porous forming face.

It is understood that the suction flow rate may vary depending on type of product molded.

It is further understood that the suction flow rate may vary between different portions of the porous forming face presenting varying porosity.

In the second forming step, a suction flow rate through the porous forming face of the second mold may be 10-50 l/sec, 50-100 l/sec, 100-250 l/sec, 250-500 l/sec, 500-750 l/sec, 750-1000 l/sec, 1000-1250 l/sec, 12501500 l/sec, 1500-1750 l/sec, 1750-2000 l/sec, or 2000-2500 l/sec per square meter of the porous forming face.

In the second forming step, a suction flow rate through the porous forming face of the second mold may be 1-50% of a suction flow rate through the porous forming face of the first mold in the first forming step, preferably 130% or 1-15% of a suction flow rate through the porous forming face of the first mold in the first forming step.

In the third forming step, a suction flow rate through the porous forming face of the third mold may be 10-2500 l/sec per square meter of the porous forming face, preferably 10-2000 l/sec per square meter of the porous forming face.

Consequently, in the third forming step, the total amount of water drawn through the porous forming face of the third mold may be 10-2500 liters/second per square meter of the porous forming face.

It is understood that the suction flow rate may vary depending on type of product molded.

It is further understood that the suction flow rate may vary between different portions of the porous forming face presenting varying porosity.

In the third forming step, a suction flow rate through the porous forming face of the third mold may be 10-50 l/sec, 50-100 l/sec, 100-250 l/sec, 250500 l/sec, 500-750 l/sec, 750-1000 l/sec, 1000-1250 l/sec, 1250-1500 l/sec, 1500-1750 l/sec, 1750-2000 l/sec, or 2000-2500 l/sec per square meter of the porous forming face.

In the third forming step, a suction flow rate through the porous forming face of the third mold may be 1-50% of a suction flow rate through the porous forming face of the second mold in the second forming step, preferably 1-30% or 1-15% of a suction flow rate through the porous forming face of the second mold in the second forming step.

DETAILED DESCRIPTION

Figure 1A:
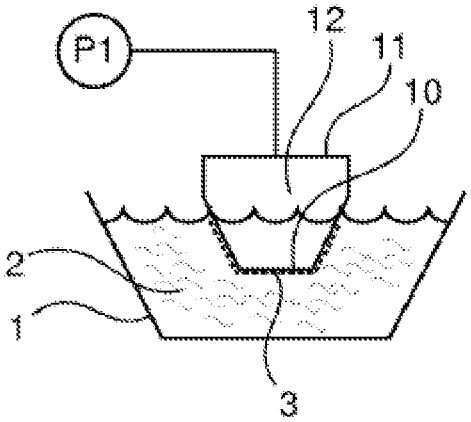
FIGS. 1*a*-1*bc* schematically illustrate a molding device.

FIG. 1*a* schematically illustrates a pickup tool 10 which is partially immersed in container 1 holding a pulp slurry 2. The pickup tool is mounted to a tool holder 11, which together with the pickup tool defines a vacuum chamber 12 that is connected to a pressure regulator P1. The pressure regulator may have the capability of selectively generating an at least partial vacuum (i.e., air pressure lower than ambient air pressure) and/or an air pressure greater than ambient air pressure.

While the pickup tool is immersed in the pulp slurry 2, the pressure regulator P1 may generate a vacuum, causing pulp fibers 3 to stick to a product face of the pickup tool 10.

Figure 1B:
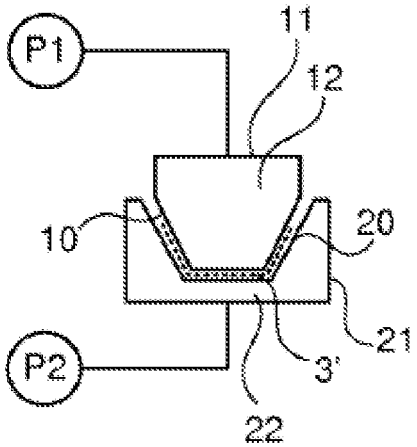

FIG. 1*b* schematically illustrates the pickup tool 10 transferring the pulp fibers 3 to a transfer tool 20. The transfer tool may be connected to a second pressure regulator P2, which is capable of generating a vacuum or an air pressure. The transfer tool may also be mounted on a transfer tool holder 21 so as to define a vacuum chamber 22, which is connected to the second pressure regulator.

During the transfer of the pulp fibers 3' from the pickup tool to the transfer tool, an air pressure greater than ambient pressure may be generated by the first pressure regulator P1 to cause the pulp fibers to release from the pickup tool.

Alternatively, or as a supplement, a vacuum may be generated by the second pressure regulator P2, causing the pulp fibers to be received by the transfer tool 20.

Figure 1C:
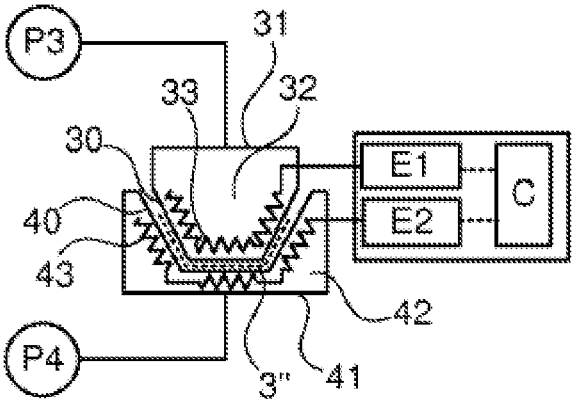

FIG. 1*c* schematically illustrates a pressing arrangement comprising a male pressing tool 30 and a female pressing tool 40. One, or both, of the pressing tools may be mounted on a respective tool holder 31, 41 and be connected to a respective vacuum chamber 32, 42. The vacuum chambers may be connected to a respective pressure regulator P3, P4.

One, or both, of the pressing tools may be provided with a heating element 33, 43, energized by an energy supply E1, E2 and optionally controlled by a controller C. The heating may be achieved by electric heating elements, hot air or liquid or induction.

The pressing tools and their associated tool holders may be movable relative one another between an open position, wherein a partially molded pulp product may be inserted, and a pressing position, wherein the pressing tools are forced towards each other thus pressing the product 3" between product faces of the respective tool 30, 40.

When in the pressing position, heat may be supplied by one, or both, of the heaters 33, 43.

During the pressing step, one or both pressure regulators P3, P4 may provide a vacuum to assist in the evacuation of water vapor from the product 3".

As an alternative, one of the pressure regulators may provide a vacuum while the other one provides a pressure greater than the ambient air pressure.

Optionally, hot air or steam may be introduced through the molds during the pressing process (FIG. 1*c*).

It is noted that two or more successive pressing steps may be used, e.g. to gradually form all or parts of the product 3" and/or to apply additional features to the product, such as coatings, decors and the like.

In one embodiment, steps are performed in accordance with what has been described with respect to FIGS. 1*a*, 1*b* and 1*c*.

Figure 2:
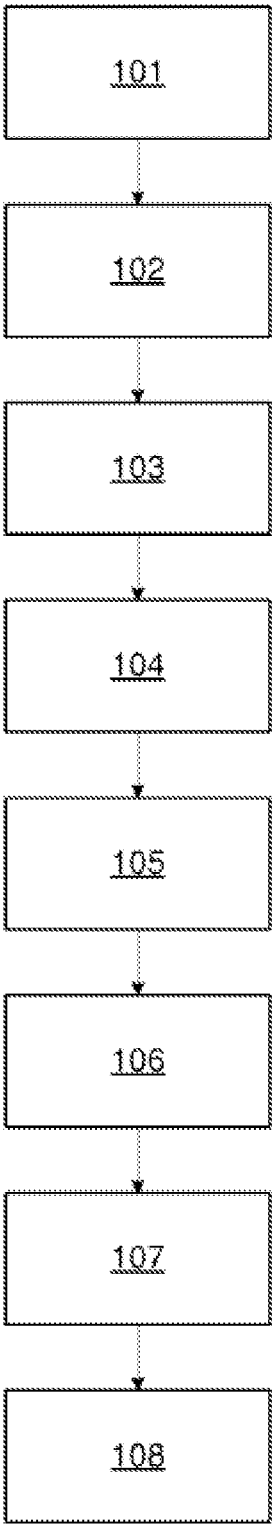
FIG. 2 schematically illustrates a production process

Referring to FIG. 2, a production process will now be described.

In a first step 101, a pulp slurry layer is provided, e.g., as described with reference to FIG. 1*a*, wherein a porous pickup tool may be submerged in a pulp slurry with vacuum being applied to a rear side of the pickup tool.

Alternatively, the pulp slurry may be applied to the pickup tool by a coating operation, such as spray coating.

The porous wall portion of the pickup tool may have a surface porosity of 40-75% with hole sizes 0.1-0.7 mm in diameter, preferably 0.25-0.6 mm.

In a second step 102, the pulp slurry layer is transferred from the pickup tool to a first press tool. The transfer may be performed by the pickup tool, or by means of a separate transfer tool, which may have a transfer tool wall portion that is porous. During the transfer step, a vacuum may be applied to the rear side of the transferring tool wall, such that the pulp slurry layer is held to the transferring tool wall. In order to release the pulp slurry layer from the transferring tool wall, it is possible to instead apply pressurized air to the rear side of the transferring tool wall.

Alternatively, the pulp slurry layer may be applied directly to the first press tool. That is, the pulp slurry layer may be formed directly on the first press tool by application of the pulp slurry to the porous forming face of the first press tool. The pulp slurry layer may be applied directly to the first press tool by submerging a tool part of the first press tool, presenting a porous wall portion, in a pulp slurry with vacuum being applied to a rear side of the porous wall portion. Alternatively, the pulp slurry may be applied to the porous forming face of the first press tool by a coating operation, such as spray coating.

Applying the pulp slurry layer to the first press tool may be preceded by forming of the pulp slurry layer from the pulp slurry. For example, a pulp slurry comprising 99-99.9% water may be applied to a porous forming face of the pickup tool as described above Further, a vacuum may be drawn through the porous forming face of the pickup tool to form the pulp slurry layer. After the drawing of vacuum through the pickup tool, a final water content of the pulp slurry layer may be about 70-90%, preferably about 70-80% by weight.

A suction flow rate through the porous forming face of the pickup tool during the forming of the pulp slurry layer from the pulp slurry may be 102500 l/sec per square meter of the porous forming face, preferably 10-2000 l/sec per square meter of the porous forming face.

A suction flow rate through the porous forming face of the porous pickup tool during the forming of the pulp slurry layer from the pulp slurry may be 10-50 l/sec, 50-100 l/sec, 100-250 l/sec, 250-500 l/sec, 500-750 l/sec, 750-1000 l/sec, 1000-1250 l/sec, 1250-1500 l/sec, 1500-1750 l/sec, 17502000 l/sec, or 2000-2500 l/sec per square meter of the porous forming face.

Consequently, a total amount of water drawn through the porous forming face of the porous pickup tool during the forming may be 10-2500 liters/second per square meter of the porous forming face.

It is understood that the suction flow rate may vary depending on type of product molded. It is further understood that the suction flow rate may vary between different portions of the porous forming face presenting varying porosity.

As an alternative to forming the pulp slurry layer before applying the pulp slurry layer to the first press tool, forming the pulp slurry layer may be performed during and/or after applying the pulp slurry layer to the first press tool. For example, a pulp slurry comprising 99-99.9% water may be applied directly to a porous forming face of the first press tool as described above. That is, the pulp slurry layer may be formed directly on the first press tool by application of the pulp slurry to the porous forming face of the first press tool.

Further, a vacuum may be drawn through the porous forming face of the first press tool to form the pulp slurry layer. After the drawing of vacuum through the first press tool, a final water content of the pulp slurry layer may be about 70-90%, preferably about 70-80% by weight.

A suction flow rate through the porous forming face of the first press tool during the forming of the pulp slurry layer from the pulp slurry may be 10-2500 l/sec per square meter of the porous forming face, preferably 10-2000 l/sec per square meter of the porous forming face.

A suction flow rate through the porous forming face of the first press tool during the forming of the pulp slurry layer from the pulp slurry may be 1050 l/sec, 50-100-250 l/sec, 250-500 l/sec, 500-750 l/sec, 750-1000 l/sec, 1000-1250 l/sec, 1250-1500 l/sec, 1500-1750 l/sec, 1750-2000 l/sec, or 2000-2500 l/sec per square meter of the porous forming face.

Consequently, a total amount of water drawn through the porous forming face of the first press tool during the forming may be 10-2500 liters/second per square meter of the porous forming face.

It is understood that the suction flow rate may vary depending on type of product molded. It is further understood that the suction flow rate may vary between different portions of the porous forming face presenting varying porosity.

In a third step 103, the pulp slurry layer may be pressed in the first press tool, which may comprise a pair of mating tool parts, one of which may have a porous wall portion, which contacts the pulp slurry layer, and through which a vacuum can be drawn.

In this first pressing step 103, a pressure lower than the surrounding ambient pressure is applied at a rear side of the porous wall portion, thus resulting in a vacuum at the rear side of the porous wall portion, causing solvent vapor, such as steam, to be drawn through the tool. The porous wall portion of the first forming tool may have a surface porosity of 40-75% with hole sizes 0.1-0.7 mm, preferably 0.25-0.6 mm.

The pressure applied to the rear side of the porous wall portion may be on the order of low or medium level vacuum. That is, a first pressure may be 200-900 mbarA (millibar absolute), preferably 300-800 mbarA. The first pressure may be 200-300 mbarA, 300-400 mbarA, 400-500 mbarA, 500-600 mbarA, 600-700 mbarA, 700-800 mbarA or 800-900 mbarA.

The drawing of vacuum through the porous forming face of the first mold may be initiated before the pressing of the pulp slurry layer against the porous forming face of the first mold is initiated.

Initiation of vacuum through the porous forming face of the mold is deemed to be initiated at the time when an underpressure, i.e. an air pressure lower than that present at the forming face is formed at the rear face of the porous forming face.

Initiation of the pressing of the pulp slurry layer against the porous forming face of the first mold part of the first mold is deemed to be initiated at first contact of the other mold part of the first mold with the pulp slurry layer.

The drawing of vacuum through the porous forming face may be initiated 0.01-1 second before the pressing of the pulp layer against the porous forming face of the first mold is initiated.

The vacuum may be drawn through the porous forming face of the first mold during a first vacuum suction time of 0.1-5.0 second, preferably 0.1-3.0 second, more preferably 0.5-2.0 second.

In the first pressing step, a suction flow rate through the porous wall portion of the first mold may be 10-2500 l/sec per square meter of the porous forming face of the first mold, preferably 10-2000 l/sec per square meter of the porous forming face of the first mold.

In the first pressing step, a suction flow rate through the porous forming face of the first mold may be 10-50 l/sec, 50-100 l/sec, 100-250 l/sec, 250-500 l/sec, 500-750 l/sec, 750-1000 l/sec, 1000-1250 l/sec, 1250-1500 l/sec, 1500-1750 l/sec, 1750-2000 l/sec, or 2000-2500 l/sec per square meter of the porous forming face.

In one embodiment, wherein the pulp slurry layer is picked up by a porous pickup tool and then transferred to the first press tool, a suction flow rate through the porous forming face of the first mold in the first pressing step, may be 1-50% of a suction flow rate through the porous forming face of the porous pickup tool during the drawing of a vacuum through the porous forming face of the pickup tool to form the pulp slurry layer from the pulp slurry, as described above. Preferably, a suction flow rate through the porous forming face of the first mold in the first pressing step may be 1-30% or 1-15% of a suction flow rate through the porous forming face of the porous pickup tool during the drawing of a vacuum through the porous forming face of the first mold to form the pulp slurry layer from the pulp slurry.

In another embodiment, wherein the pulp slurry layer is picked up by the first press tool or applied directly to a porous forming face of the first press tool, a suction flow rate through the porous forming face of the first press tool in the first pressing step, may be 1-50% of a suction flow rate through the porous forming face of the first press tool during the drawing of a vacuum through the porous forming face of the first press tool to form the pulp slurry layer from the pulp slurry, as described above. Preferably, a suction flow rate through the porous forming face of the first press tool in the first pressing step may be 1-30% or 1-15% of a suction flow rate through the porous forming face of the first press tool during the drawing of a vacuum through the porous forming face of the first press tool to form the pulp slurry layer from the pulp slurry.

The forming face of the first mold may be heated to about 150-500° C., preferably 150-400° C., 200-500° C., 200-400° C. or 200-300° C., and in most cases 240-280° C. Typically, all mold faces contacting the pulp slurry layer are heated.

A pressing pressure between mold faces may be on the order of about 390-1570 kPa, and in most cases 580-1170 kPa.

The pressing pressure may be applied during a first pressing time of 0.1-4.0 second, preferably 0.5-2.0 second. In most settings, a pressing time on the order of 0.5-1.5 second is sufficient, and often also 0.5-1 second.

Typically, in this first step, an initial water content of the pulp slurry layer is % by weight and after the pressing step has been performed, a final water content may be 45-65% by weight, typically about 50-60% by weight.

After the first pressing step 103, the pulp slurry layer, now with a substantial amount of its solvent removed, may be transferred 104 to a second press tool. The transfer 104 may be performed in the same manner as the first transfer step 102, and with similar equipment. The second press tool may be designed essentially as the first press tool.

In a second pressing step 105, the pulp slurry layer may be pressed in the second press tool, which may comprise a pair of mating tool parts, one of which may have a porous wall portion, which contacts the pulp slurry layer, and through which a vacuum can be drawn. In this second pressing step 105, a pressure lower than the surrounding ambient pressure is applied at a rear side of the porous wall portion, thus resulting in a vacuum at the rear side of the porous wall portion, causing solvent vapor, such as steam, to be drawn through the tool.

The porous wall portion of the second forming tool may have a surface porosity of 25-50% with hole sizes 0.1-1.2 mm, preferably 0.25-1.0 mm.

However, in the second pressing step 105, the pressure applied at to the rear side of the porous wall portion may be higher than that provided in the first pressing step 103.

In particular, the pressure provided in the first pressing step 103 may be 1-99% of that provided in the second pressing step 105, preferably 50-99%, 90-99%, 95-99% or 99-99.9%.

In the second pressing step, the absolute pressure applied to the rear side of the porous forming face of the second mold may be 200-900 mbarA, preferably 300-800 mbarA, but always greater than in the first pressing step.

The second pressure may be 200-300 mbarA, 300-400 mbarA, 400-500 mbarA, 500-600 mbarA, 600-700 mbarA, 700-800 mbarA or 800-900 mbarA.

The drawing of vacuum through the porous forming face of the second mold may be initiated before the pressing of the pulp slurry layer against the porous forming face of the second mold is initiated.

Initiation of vacuum through the porous forming face of the mold is deemed to be initiated at the time when an underpressure, i.e. an air pressure lower than that present at the forming face is formed at the rear face of the porous forming face.

Initiation of the pressing of the pulp slurry layer against the porous forming face of the first mold part of the second mold is deemed to be initiated at first contact of the other mold part of the second mold with the pulp slurry layer.

The drawing of vacuum through the porous forming face may be initiated 0.01-1 second before the pressing of the pulp layer against the porous forming face of the second mold is initiated.

The vacuum may be drawn through the porous forming face of the second mold during a second vacuum suction time of 0.1-5.0 second, preferably 0.1-3.0 second, more preferably 0.5-2.0 second.

In the second pressing step, a suction flow rate through the porous wall portion of the second mold may be 10-2500 l/sec per square meter of the porous forming face of the second mold, preferably 10-2000 l/sec per square meter of the porous forming face of the second mold.

A suction flow rate through the porous forming face of the second mold may be 10-50 l/sec, 50-100 l/sec, 100-250 l/sec, 250-500 l/sec, 500-750 l/sec, 750-1000 l/sec, 1000-1250 l/sec, 1250-1500 l/sec, 1500-1750 l/sec, 17502000 l/sec, or 2000-2500 l/sec per square meter of the porous forming face.

In the second pressing step, a suction flow rate through the porous forming face of the second mold may be 1-50% of a suction flow rate through the porous forming face of the first mold in the first pressing step, preferably 1-30% or 1-15% of a suction flow rate through the porous forming face of the first mold in the first pressing step.

The forming face of the second mold may be heated to about 110-500° C., preferably 110-400° C., 150-500° C., 150-400° C., 200-500° C., 200-400° C. or 200-300° C., and in most cases 240-280° C. Typically, all mold faces making up the second mold and contacting the pulp slurry layer may be heated.

A pressing pressure between mold faces may be on the order of about 390-1570 kPa, and in most cases 580-1170 kPa.

The pressing pressure may be applied during a second pressing time of 0.1-4.0 second, preferably 0.5-2.0 second. In most settings, a pressing time on the order of 0.5-1.5 second is sufficient, and often also 0.5-1 second.

Typically, in this second pressing step, an initial water content of the pulp slurry layer may be about 45-65%, typically about 50-60% by weight. A final water content may be about 25-40% by weight, preferably about 30-35% by weight.

After the second pressing step 105, the pulp slurry layer, now with a substantial amount of its solvent removed, may be transferred 106 to a third press tool. The transfer 106 may be performed in the same manner as the first transfer step 102 and/or the second transfer step 104, and with similar equipment. The third press tool may be designed essentially as the first press tool.

In a third pressing step 107, the pulp slurry layer may be pressed in the third press tool, which may comprise a pair of mating tool parts, one of which may have a porous wall portion, which contacts the pulp slurry layer, and through which a vacuum can be drawn. In this third pressing step 107, a pressure lower than the surrounding ambient pressure is applied at a rear side of the porous wall portion, thus resulting in a vacuum at the rear side of the porous wall portion, causing solvent vapor, such as steam, to be drawn through the tool.

The porous wall portion of the third forming tool may have a surface porosity of 25-50% with hole sizes 0.1-1.2 mm, preferably 0.25-1.0 mm.

However, in the third pressing step 107, the pressure applied at to the rear side of the porous wall portion may be higher than that provided in the second pressing step 105.

In particular, the pressure provided in the second pressing step 105 may be 1-99% of that provided in the third pressing step 107, preferably 50-99%, 90-99%, 95-99% or 99-99.9%.

In the third pressing step, an absolute pressure provided at the rear of the porous wall portion of the third mold may be 200-900 mbarA, preferably 300-800 mbarA, but always greater than in the second pressing step.

The third pressure may be 200-300 mbarA, 300-400 mbarA, 400-500 mbarA, 500-600 mbarA, 600-700 mbarA, 700-800 mbarA or 800-900 mbarA.

The drawing of vacuum through the porous forming face of the third mold may be initiated before the pressing of the pulp slurry layer against the porous forming face of the third mold is initiated.

Initiation of vacuum through the porous forming face of the mold is deemed to be initiated at the time when an underpressure, i.e. an air pressure lower than that present at the forming face is formed at the rear face of the porous forming face.

Initiation of the pressing of the pulp slurry layer against the porous forming face of the first mold part of the third mold is deemed to be initiated at first contact of the other mold part of the third mold with the pulp slurry layer.

The drawing of vacuum through the porous forming face may be initiated 0.01-1 second before the pressing of the pulp layer against the porous forming face of the third mold is initiated.

The vacuum may be drawn through the porous forming face of the third mold during a third vacuum suction time of 0.1-5.0 second, preferably 0.1-3.0 second, more preferably 0.5-2.0 second.

In the third pressing step, a suction flow rate through the porous wall portion of the third mold may be 10-2500 l/sec per square meter of the porous forming face of the third mold, preferably 10-2000 l/sec per square meter of the porous forming face of the third mold.

A suction flow rate through the porous forming face of the third mold may be 10-50 l/sec, 50-100 l/sec, 100-250 l/sec, 250-500 l/sec, 500-750 l/sec, 750-1000 l/sec, 1000-1250 l/sec, 1250-1500 l/sec, 1500-1750 l/sec, 17502000 l/sec, or 2000-2500 l/sec per square meter of the porous forming face. In the third pressing step, a suction flow rate through the porous forming face of the third mold may be 1-50% of a suction flow rate through the porous forming face of the second mold in the second pressing step, preferably 1-30% or 1-15% of a suction flow rate through the porous forming face of the second mold in the second pressing step.

The forming face of the third mold may be heated to about 100-400° C., preferably 100-300° C., 150-400° C., 150-300° C., 200-300° C. or 200-280° C., and in most cases 240-280° C. Typically, all mold faces making up the third mold and contacting the pulp slurry layer may be heated.

A pressing pressure between mold faces may be on the order of about 390-1570 kPa, and in most cases 580-1170 kPa.

The pressing pressure may be applied during a third pressing time of 0.1-4.0 second, preferably 0.5-2.0 second. In most settings, a pressing time on the order of 0.5-1.5 second is sufficient, and often also 0.5-1 second.

Typically, in this third pressing step, an initial water content of the pulp slurry layer may be about 25-45% or 25-40% by weight, preferably about 30-40% or 30 35% by weight, and a final water content may be less than about 5% by weight, preferably less than about 1% by weight.

After the third pressing step 107, the pulp slurry layer, now with most of its solvent removed, may be transferred 108 out of the machine.

Optionally, additional steps, such as surface treatment, cutting or printing may be performed on the thus essentially dry product. The product may then be packaged, stored and shipped.

It is noted that the third pressing step 107, and thus also its related transfer step 106, is optional. Hence, the process may be finished after the second pressing step 105 with the output step 108 following immediately.

Thus, in the first pressing step, an initial water content of the pulp slurry layer may be 70-90% by weight and a final water content may be 25-50% by weight, preferably about 30-35% by weight.

In the second pressing step, an initial water content of the pulp slurry layer may be about 25-50%, preferably about 30-35% by weight, and a final water content may be less than about 5% by weight, preferably less than about 1% by weight.

In a specific example, a 10 g pulp tray, of the kind used to package meat, was produced. A pickup tool comprising a porous pickup mold was submerged into an 1.1-0.5% by weight European white birch pulp slurry for 0.5-1.5 seconds. An absolute pressure of 200-700 mbarA was applied to the rear side of the pickup tool.

The pulp slurry layer thus picked up was lifted off the pickup tool using a first transfer tool having a porous mold to the rear side of which a vacuum of 200 mbarA was applied. The pulp slurry layer was transferred to a first press mold.

In the first press mold, the pulp slurry layer was subjected to a pressing pressure of 100 kPa during 0.7 second, while the porous forming faces were heated to 270° C. and a vacuum level of 750 mbarA was applied to the rear side of the porous forming faces.

A second transfer tool, similar to the first transfer tool, was used to pick the pulp slurry layer off the first pressing tool and place it onto the second pressing tool. The second transfer tool applied a vacuum of 200 mbarA to the rear side of the transfer tool's porous surface, for 1 second.

The initial weight of the pulp slurry layer applied onto the first mold forming face was 46 g. After the first pressing operation, the total weight of the pulp slurry layer was 22.4 g.

In the second press mold, the pulp slurry layer was subjected to a pressing pressure of 390 kPa during 1.9 second, while the porous forming faces were heated to 240° C. and a vacuum level of 800 mbarA was applied to the porous forming faces.

A third transfer tool, similar to the first and second transfer tools, was used to pick the pulp slurry layer off the second pressing tool and place it onto the third pressing tool. The third transfer tool applied a vacuum of 200 mbarA to the rear side of the transfer tool's porous surface, for 1 second.

The initial weight of the pulp slurry layer applied onto the second mold forming face was 22 g. After the second pressing operation, the total weight of the pulp slurry layer was 15.2 g.

In the third press mold, the pulp slurry layer was subjected to a pressing pressure of 390 kPa during 2 seconds, while the porous forming faces were heated to 220° C. and a vacuum level of 800 mbarA was applied to the porous forming faces.

A fourth transfer tool, similar to the first, second and third transfer tools, was used to pick the pulp slurry layer, which now was essentially finished, off the third pressing tool and place it onto a conveyor belt. The fourth transfer tool applied a vacuum of 200 mbarA to the rear side of the transfer tool's porous surface, for 1 second.

The initial weight of the pulp slurry layer applied onto the third mold forming face was 15 g. After the first pressing operation, the total weight of the pulp slurry layer was 10.1 g. It is noted that the vacuum sources provided must be dimensioned so as to provide a flow that is sufficient to evacuate the amount of steam generated during the heating/pressing steps, and also to accommodate the liquid water that is drawn out by the vacuum applied to the respective mold.

The invention claimed is:

1. A method of producing a 3D molded product from a pulp slurry, comprising:

providing a first mold comprising a porous wall portion through which a vacuum can be drawn, the porous wall portion having a porous forming face and a rear face, providing a second mold comprising a porous wall portion through which a vacuum can be drawn, the porous wall portion having a porous forming face and a rear face, applying a pulp slurry layer to a porous forming face of the first mold, in a first forming step, pressing the pulp slurry layer against the porous forming face of the first mold with a pressing tool, while heating the pulp slurry layer and drawing a vacuum through the porous forming face of the first mold by applying a first pressure to the rear face of first mold, transferring the pulp slurry layer to the porous forming face of the second mold, in a second, subsequent, forming step, pressing the pulp slurry layer against the porous forming face of the second mold with a pressing tool, while heating the pulp slurry layer and drawing a vacuum through the porous forming face of the second mold by applying a second pressure to the rear face of second mold, wherein the first pressure at the rear face of the first mold is lower than the second pressure at the rear face of the second mold, and wherein the first pressure is from about 22.2% to about 88.5% of the second pressure.

2. The method as claimed in claim 1, wherein the first pressure is from about 66.7% to about 88.5% of the second pressure.

3. The method as claimed in claim 1, wherein the first pressure is 200-900 mbarA.

4. The method as claimed in claim 1, wherein the drawing of vacuum through the porous forming face of the first mold is initiated before the pressing of the pulp slurry layer against the porous forming face of the first mold is initiated.

5. The method as claimed in claim 4, wherein the drawing of vacuum through the porous forming face is initiated 0.01-1 second before the pressing of the pulp layer against the porous forming face of the first mold is initiated.

6. The method as claimed in claim 1, wherein the vacuum is drawn through the porous forming face of the first mold during a first vacuum suction time of 0.1-5.0 second.

7. The method as claimed in claim 1, wherein, in the first forming step, the forming face of the first mold is heated to about 150-500° C.

8. The method as claimed in claim 1, wherein, in the first forming step, the pulp slurry layer is pressed against the forming face of the first mold with a pressure of about 390-1570 kPa.

9. The method as claimed in claim 1, wherein, in the first forming step, the pulp slurry layer is pressed against the forming face of the first mold during a first pressing time of 0.1-4.0 second.

10. The method as claimed in claim 1, wherein, in the first forming step, an initial water content of the pulp slurry layer is 70-90% by weight and wherein a final water content is 45-65% by weight.

11. The method as claimed in claim 1, wherein, in the second forming step, the forming face of the second mold is heated to about 110-500° C.

12. The method as claimed in claim 1, wherein, in the second forming step, an initial water content of the pulp slurry layer is about 45-65% by weight, and wherein a final water content is about 25-40% by weight.

13. The method as claimed in claim 1, further comprising:

providing a third mold comprising a porous wall portion through which a vacuum can be drawn, the porous wall portion having a porous forming face and a rear face, transferring the pulp slurry layer to the porous forming face of the third mold, and in a third, subsequent, forming step, pressing the pulp slurry layer against the porous forming face of the third mold with a pressing tool, while heating the pulp slurry layer and drawing a vacuum through the porous forming face of the third mold by applying a third pressure to the rear face of the third mold, wherein the second pressure at the rear face of the second mold is lower than the third pressure at the rear face of the third mold.

14. The method as claimed in claim 13, wherein, in the third forming step, the forming face of the third mold is heated to about 100-300° C.

15. The method as claimed in claim 1, wherein, in the first forming step, an initial water content of the pulp slurry layer is 70-90% by weight and wherein a final water content is 25-50% by weight.

16. The method as claimed in claim 1, wherein, in the second forming step, an initial water content of the pulp slurry layer is about 25-50%, and wherein a final water content is less than about 5% by weight.

17. The method as claimed in claim 1, wherein said applying a pulp slurry layer to a porous forming face of a first mold is preceded by a step of applying a pulp slurry comprising 99-99.9% water to a porous forming face of a pickup mold, and drawing a vacuum through the porous forming face of the pickup mold to form the pulp slurry layer.

18. The method as claimed in claim 1, wherein said applying a pulp slurry layer to a porous forming face of a first mold comprises applying a pulp slurry comprising 99-99.9% water to the porous forming face of the first mold, and drawing a vacuum through the porous forming face of the first mold to form the pulp slurry layer.

19. The method as claimed in claim 18, wherein, a suction flow rate through the porous forming face of the first mold, during the drawing of a vacuum through the porous forming face of the first mold to form the pulp slurry layer from the pulp slurry is 10-2500 l/sec per square meter of the porous forming face.

20. The method as claimed in claim 18, wherein, in the first forming step, a suction flow rate through the porous forming face of the first mold is 1-50% of a suction flow rate through the porous forming face of the first mold during the drawing of a vacuum through the porous forming face of the first mold to form the pulp slurry layer from the pulp slurry.

* * * * *